US007464884B2

(12) United States Patent
Akabane

(10) Patent No.: US 7,464,884 B2
(45) **Date of Patent: *Dec. 16, 2008**

(54) FUEL INJECTION VALVE

(75) Inventor: Akira Akabane, Miyagi (JP)

(73) Assignee: Keihin Corporation, Tokyo (JP)

( * ) Notice: Subject to any disclaimer, the term of this patent is extended or adjusted under 35 U.S.C. 154(b) by 168 days.

This patent is subject to a terminal disclaimer.

(21) Appl. No.: 11/579,315

(22) PCT Filed: Jun. 10, 2005

(86) PCT No.: PCT/JP2005/010653

§ 371 (c)(1),
(2), (4) Date: Nov. 1, 2006

(87) PCT Pub. No.: WO2005/124147

PCT Pub. Date: Dec. 29, 2005

(65) Prior Publication Data

US 2007/0215114 A1 Sep. 20, 2007

(30) Foreign Application Priority Data

Jun. 21, 2004 (JP) ..... 2004-182306

(51) Int. Cl.
*F02M 61/00* (2006.01)

(52) U.S. Cl. ..... 239/533.12; 239/552; 239/585.1; 239/585.5; 239/596

(58) Field of Classification Search ..... 239/533.12, 239/552, 584, 585.1, 585.4, 585.5, 596
See application file for complete search history.

(56) References Cited

U.S. PATENT DOCUMENTS 6,616,071 B2 * 9/2003 Kitamura et al. ..... 239/533.12
7,341,204 B2 * 3/2008 Akabane ..... 239/596
2004/0050976 A1 3/2004 Kitamura

FOREIGN PATENT DOCUMENTS

| | | | |
|---|---|---|---|
| JP | 7-332201 | A | 12/1995 |
| JP | 2000-97129 | A | 4/2000 |
| JP | 2002-130074 | A | 5/2002 |
| JP | 2004-19610 | A | 1/2004 |
| JP | 2004-169571 | A | 6/2004 |
| JP | 2004-169572 | A | 6/2004 |

* cited by examiner

*Primary Examiner*—Steven J Ganey
(74) *Attorney, Agent, or Firm*—Arent Fox LLP

(57) ABSTRACT

A fuel injection valve is provided in which a funnel-shaped fuel collecting depression (35) is provided between a valve seat (8) and an outlet hole (7) of a valve seat member (3), the depression (35) collecting fuel that has passed through the valve seat (8) and guiding it to the outlet hole (7), and a flat fuel diffusion chamber (36) for radially outwardly diffusing fuel that has passed through the outlet hole (7) and guiding it to a plurality of fuel injection holes (11) is provided between opposing faces of the valve seat member (3) and an injector plate (10), an inner peripheral face (7A) of the outlet hole (7) being formed along a curved face on the inner peripheral side of a virtual torus (T) so that the inner peripheral face (7A) is continuous with the base of the fuel collecting depression (35) and the roof of the fuel diffusion chamber (36). This prevents eddies from being generated when fuel is reversed at the outlet hole of the valve seat member, thus enabling pressure loss of the fuel to be reduced, reduction in the amount of fuel injected to be suppressed, atomization of injected fuel to be promoted, and a spray form to be stabilized.

3 Claims, 3 Drawing Sheets

FUEL INJECTION VALVE

CROSS REFERENCE TO RELATED APPLICATION

This application is a National Stage entry of Internation Application No. PCT/JP2005/01653, filed Jun. 10,2005, the entire specification claims and drawings of which are incorporated herewith by reference.

TECHNICAL FIELD

The present invention relates to a fuel injection valve that is used mainly in a fuel supply system of an internal combustion engine and, in particular, to an improvement of a fuel injection valve that includes a valve seat member having at one end portion thereof a valve seat and an outlet hole running through a central portion of the valve seat, a valve body housed in the valve seat member and opening and closing the valve seat, and an injector plate joined to one end face of the valve seat member and having a plurality of fuel injection holes disposed so as to be radially outwardly spaced from the outlet hole, a funnel-shaped fuel collecting depression for collecting fuel that has passed through the valve seat and guiding the fuel to the outlet hole being provided between the valve seat and the outlet hole, and a flat fuel diffusion chamber for radially outwardly diffusing fuel that has passed through the outlet hole and guiding the fuel to the plurality of fuel injection holes being provided between opposing faces of the valve seat member and the injector plate.

BACKGROUND ART

Such a fuel injection valve is already known, as disclosed in the following Patent Document 1.

Patent Document 1:

Japanese Patent Application Laid-open No. 2000-97129

DISCLOSURE OF THE INVENTION

Problem to be Solved the Invention

In such a fuel injection valve, when the valve body is opened, fuel that has passed through the valve seat is guided to the outlet hole by the fuel collecting depression, the flow is reversed from the outlet hole to the fuel diffusion chamber, and the fuel is diffused radially outwardly and injected from the plurality of fuel injection holes of the injector plate, thus forming a spray form.

In the conventional fuel injection valve, since the inner peripheral face of the outlet hole is cylindrical, and an angle formed between the base of the fuel collecting depression and the inner peripheral face of the outlet hole and an angle formed between the inner peripheral face of the outlet hole and the roof of the fuel diffusion chamber are right angles or close to right angles, when the flow of fuel is reversed at the outlet hole, a large number of eddies are generated on the inside of the reversal, and such eddies increase pressure loss of the fuel, thereby causing a reduction in the amount of fuel injected, preventing the fuel injected from the fuel injection holes from being atomized, making the direction and the shape of the spray form unstable, etc.

The present invention has been accomplished under such circumstances, and it is an object thereof to provide a fuel injection valve that prevents eddies from being generated when fuel is reversed at the outlet hole, thus enabling pressure loss of the fuel to be reduced, reduction in the amount of fuel injected to be suppressed, atomization of the injected fuel to be promoted, and the spray form to be stabilized.

Means for Solving the Problem

In order to achieve the above object, in accordance with a first aspect of the present invention, there is provided a fuel injection valve comprising: a valve seat member having at one end portion thereof a valve seat and an outlet hole running through a central portion of the valve seat; a valve body housed in the valve seat member and opening and closing the valve seat; an injector plate joined to one end face of the valve seat member and having a plurality of fuel injection holes disposed so as to be radially outwardly spaced from the outlet hole; a funnel-shaped fuel collecting depression provided between the valve seat and the outlet hole, the funnel-shaped fuel collecting depression collecting fuel that has passed through the valve seat and guiding the fuel to the outlet hole; and a flat fuel diffusion chamber provided between opposing faces of the valve seat member and the injector plate, the fuel diffusion chamber radially outwardly diffusing fuel that has passed through the outlet hole and guiding the fuel to the plurality of fuel injection holes; characterized in that the outlet hole has an inner peripheral face thereof formed along a curved face on the inner peripheral side of a virtual torus so that the inner peripheral face is continuous with the base of the fuel collecting depression and the roof of the fuel diffusion chamber.

In accordance with a second aspect of the present invention, in addition to the first aspect, there is provided a fuel injection valve, wherein the virtual torus is set so that a center of a circular generatrix thereof is positioned on a bisector of an angle formed between the base of the fuel collecting depression and the roof of the fuel diffusion chamber.

In accordance with a third aspect of the present invention, in addition to the first aspect, there is provided a fuel injection valve, wherein the fuel diffusion chamber has a height thereof set at no more than ½ a radius of the circular generatrix of the virtual torus.

In accordance with a fourth aspect of the present invention, in addition to any one of the first to third aspect, there is provided a fuel injection valve, wherein a seating portion of the valve body that is to be seated on the valve seat is formed in a spherical band shape, and a tip of the valve body that faces a section extending from the fuel collecting depression to the outlet hole is formed in a projecting cone shape.

In accordance with a fifth aspect of the present invention, in addition to any one of the first to fourth aspect, there is provided a fuel injection valve, wherein the inner peripheral face of the outlet hole is formed by connecting a plurality of conical faces having different conical angles or by connecting a plurality of conical faces having different conical angles and a cylindrical face positioned therebetween, the plurality of conical faces being in contact with the curved face on the inner peripheral side of the virtual torus.

EFFECT OF THE INVENTION

In accordance with the first aspect of the present invention, since the inner peripheral face of the outlet hole of the valve seat member is formed along the curved face on the inner peripheral side of the virtual torus so as to be continuous with the base of the fuel collecting depression and the roof of the fuel diffusion chamber, the reversal of flow of fuel within the outlet hole can be guided very smoothly by the inner peripheral face and eddies are prevented from being generated on the inside of the flow, thus enabling pressure loss of the fuel to be reduced, the atomization of injected fuel to be promoted, and the spray form to be stabilized without an accompanying reduction in the amount of fuel injected from each of the fuel injection holes of the injector plate, thereby contributing to a lowering of the engine fuel consumption and an improvement in output performance.

Furthermore, in accordance with the second aspect of the present invention, since the virtual torus is set so that the center of the circular generatrix thereof is positioned on the bisector of the angle formed between the base of the funnel-shaped fuel collecting depression and the roof of the fuel diffusion chamber, it is possible to smoothly join the inner peripheral face of the outlet hole to the base of the fuel collecting depression and the roof of the fuel diffusion chamber, thus enabling the flow of fuel to be more smoothly reversed within the outlet hole and thereby reliably preventing eddies from being generated on the inside of the flow.

Moreover, in accordance with the third aspect of the present invention, setting the height of the fuel diffusion chamber at no more than ½ the radius of the circular generatrix of the virtual torus increases the rate at which fuel diffuses in the fuel diffusion chamber, thus promoting the release of fuel at the open edge of each of the fuel injection holes, and thereby enabling injected fuel to be atomized effectively; moreover, after fuel is injected, residual fuel can be reliably retained in the fuel diffusion chamber by virtue of capillary action, thus preventing fuel from dripping from the fuel injection hole and thereby contributing to a reduction in emissions.

Furthermore, in accordance with the fourth aspect of the present invention, since the tip of the valve portion facing the fuel collecting depression and the outlet hole is formed in the projecting conical shape so as to be continuous with the spherical band-shaped seating portion, this tip can reduce the dead volume of central portions of the fuel collecting depression and the outlet hole, and a flow-straightening effect can be exhibited so as to promote collection and guiding of fuel from the fuel collecting depression to the outlet hole, thus reducing pressure loss of the fuel.

Moreover, in accordance with the fifth aspect of the present invention, since the inner peripheral face of the outlet hole is formed by connecting the plurality of conical faces, which are in contact with the curved face on the inner peripheral side of the virtual torus and have different conical angles, or by connecting the plurality of conical faces having different conical angles and a cylindrical face positioned therebetween, the inner peripheral face along the curved face on the inner peripheral side of the virtual torus can be machined relatively easily by cutting, etc.

DESCRIPTION OF THE REFERENCE NUMERALS AND CHARACTERS

Figure 1:
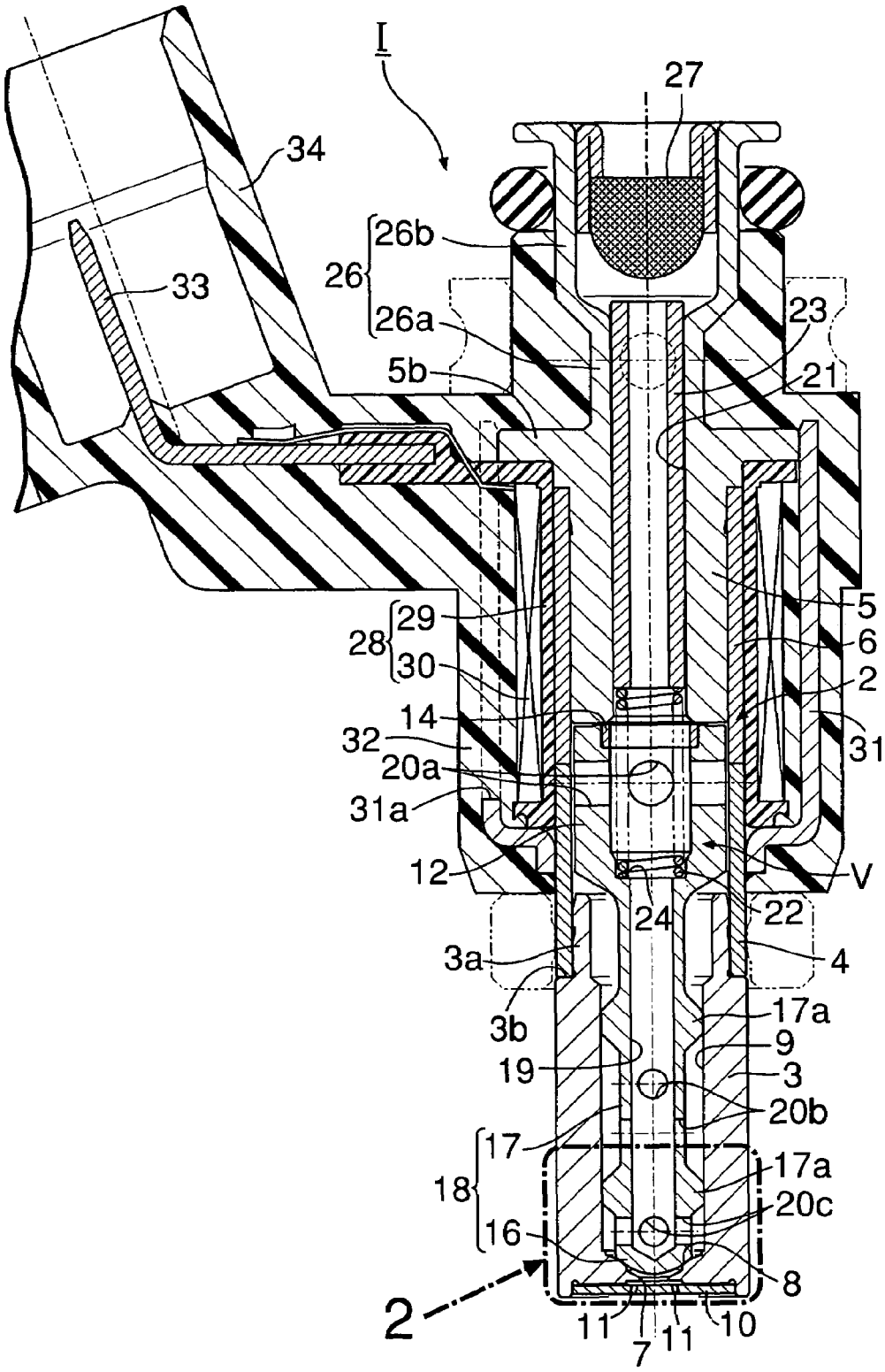
FIG. 1 is a vertical sectional view of an internal combustion engine electromagnetic fuel injection valve related to an embodiment of the present invention (first embodiment).

I fuel injection valve
T virtual torus
Ta circular generatrix of virtual torus
To center of the above-described circular generatrix
r radius of the center of the above-described circular generatrix
3 valve seat member
7 outlet hole
7A inner peripheral face of outlet hole
7*a*, 7*b* conical face forming part of the above-described inner peripheral
7*c* cylindrical face forming part of the above-described inner peripheral
8 valve seat
18 valve body
35 fuel collecting depression
36 fuel diffusion chamber

BEST MODE FOR CARRYING OUT THE INVENTION

A mode for carrying out the present invention is explained below by reference to a preferred embodiment of the present invention shown in the attached drawings.

Embodiment 1

An embodiment of the present invention is explained by reference to FIG. 1 to FIG. 3. Firstly, in FIG. 1 and FIG. 2, a valve housing 2 of an internal combustion engine electromagnetic fuel injection valve I is formed from a cylindrical valve seat member 3 having a valve seat 8 at the front end thereof, a cylindrical magnetic body 4 joined coaxially to a rear end portion of the valve seat member 3, and a cylindrical non-magnetic body 6 coaxially joined to the rear end of the cylindrical magnetic body 4.

The valve seat member 3 has, in the rear end portion thereof, a tubular connecting portion 3*a* projecting toward the cylindrical magnetic body 4 side with an annular shoulder portion 3*b* from the outer peripheral face of the valve seat member 3, and by press-fitting this tubular connecting portion 3*a* into an inner peripheral face of a front end portion of the cylindrical magnetic body 4 so as to make a front end face of the cylindrical magnetic body 4 abut against the annular shoulder portion 3*b*, the valve seat member 3 and the cylindrical magnetic body 4 are joined to each other coaxially in a liquid-tight manner. The cylindrical magnetic body 4 and the cylindrical non-magnetic body 6 are joined to each other coaxially in a liquid-tight manner by laser beam-welding along the entire periphery while making opposing end faces thereof abut against each other.

The valve seat member 3 includes a cylindrical guide hole 9, a conical valve seat 8 connected to the front end of the guide hole 9, and an outlet hole 7 running through a central portion of the valve seat 8. An injector plate 10 made of a steel plate is welded to a front end face of the valve seat member 3 along the entire periphery in a liquid-tight manner, the injector plate 10 having a plurality of fuel injection holes 11 communicating with the outlet hole 7.

A hollow cylindrical fixed core 5 is press-fitted into an inner peripheral face of the cylindrical non-magnetic body 6 from the rear end side thereof and fixed thereto in a liquid-tight manner. During this process, a section of a front end portion of the cylindrical non-magnetic body 6 remains unmated with the fixed core 5, and a valve assembly V is housed in the interior of the valve housing 2 extending from this section to the valve seat member 3.

The valve assembly V includes a valve body 18 formed from a valve portion 16 that opens and closes the valve seat 8 and a valve stem portion 17 supporting the valve portion 16, and a movable core 12 that is connected to the valve stem portion 17, is inserted so as to straddle the cylindrical magnetic body 4 and the cylindrical non-magnetic body 6, and is disposed so as to coaxially oppose the fixed core 5.

The valve stem portion 17 is formed so as to have a diameter smaller than that of the guide hole 9 and has a pair of front and rear journal portions 17*a* formed integrally with the outer periphery thereof, the journal portions 17*a* projecting radially outwardly and being slidably supported on the inner peripheral face of the guide hole 9. In this arrangement, the two journal portions 17*a* are disposed so that the axial spacing between the two is as large as possible.

The valve assembly V is provided with a lengthwise hole 19 extending from the rear end face of the movable core 12 up to just before the valve portion 16, a plurality of first lateral holes 20*a* providing communication between the lengthwise hole 19 and an outer peripheral face of the movable core 12, a plurality of second lateral holes 20*b* providing communication between the lengthwise hole 19 and an outer peripheral face of the valve stem portion 17 between the two journal portions 17*a*, and a plurality of third lateral holes 20*c* providing communication between the lengthwise hole 19 and an outer peripheral face of the valve portion 16. Here, an annular spring seat 24 facing the fixed core 5 side is formed partway along the lengthwise hole 19.

The fixed core 5 has a lengthwise hole 21 communicating with the lengthwise hole 19 of the movable core 12, and a fuel inlet tube 26 is provided integrally with the rear end of the fixed core 5, the interior of the fuel inlet tube 26 communicating with the lengthwise hole 21. The fuel inlet tube 26 is formed from a decreased diameter portion 26*a* connected to the rear end of the fixed core 5 and an increased diameter portion 26*b* that is a continuation of the decreased diameter portion 26*a*, and a valve spring 22 is provided in compression between the spring seat 24 and a pipe-shaped retainer 23 fitted by inserting into the lengthwise hole 21 from the decreased diameter portion 26*a* and fixed by swaging, the valve spring 22 urging the movable core 12 in a direction that closes the valve body 18. During this process, a set load of the valve spring 22 is adjusted by the depth to which the retainer 23 is fitted into the lengthwise hole 21, and subsequent to the adjustment the retainer 23 is fixed to the decreased diameter portion 26*a* by partially inwardly swaging an outer peripheral wall of the decreased diameter portion 26*a*. A fuel filter 27 is mounted in the increased diameter portion 26*b*.

The fixed core 5 is made of a high hardness ferrite magnetic material. A collar-shaped stopper element 14 surrounding the valve spring 22 is embedded in an attracting face of the movable core 12, which opposes an attracting face of the fixed core 5. This stopper element 14 has the outer end thereof projecting slightly from the attracting face of the movable core 12 and is normally disposed so as to oppose the attracting face of the fixed core 5 across a gap corresponding to a valve-opening stroke of the valve body 18.

A coil assembly 28 is fitted around the outer periphery of the valve housing 2 so as to correspond to the fixed core 5 and the movable core 12. This coil assembly 28 is formed from a bobbin 29 fitted around an outer peripheral face of the rear end portion of the cylindrical magnetic body 4 and an outer peripheral face of the entire cylindrical non-magnetic body 6, and a coil 30 wound around the bobbin 29; the front end of a coil housing 31 surrounding the coil assembly 28 is welded to the outer peripheral face of the cylindrical magnetic body 4, and the rear end of the coil housing 31 is welded to an outer peripheral face of a yoke 5*b* projecting from the outer periphery of a rear end portion of the fixed core 5 in a flange shape. The coil housing 31 has a cylindrical shape and has formed in one side thereof a slit 31*a* extending in the axial direction.

The coil housing 31, the coil assembly 28, the fixed core 5, and the front half of the fuel inlet tube 26 are embedded in a covering body 32 made of a synthetic resin by injection molding. During this process, the interior of the coil housing 31 is filled with the covering body 32 via the slit 31*a*. Furthermore, a coupler 34 housing a connecting terminal 33 connected to the coil 30 is provided so as to be connected integrally to a middle section of the covering body 32.

The structure around the valve seat 8 and the valve portion 16 is explained in detail by reference to FIG. 2 and FIG. 3.

The valve seat 8 of the valve seat member 3 is formed in a conical shape, and a funnel-shaped fuel collecting depression 35 for collecting fuel that has passed through the valve seat 8 and guiding it to the outlet hole 7 is formed between the valve seat 8 and the outlet hole 7.

On the other hand, the valve portion 16 of the valve body 18 is provided with a spherical band-shaped seating portion 16*a* that is seated on the valve seat 8 and a projecting conical tip 16*b* facing a section extending from the fuel collecting depression 35 to the outlet hole 7. The spherical band-shaped seating portion 16*a* has its center on the axis of the valve body 18.

A flat fuel diffusion chamber 36 extending radially outwardly from the outlet hole 7 and radially outwardly diffusing fuel that has passed through the outlet hole 7 is formed between opposing faces of the valve seat member 3 and the injector plate 10. This fuel diffusion chamber 36 is formed as a depression in a front end face of the valve seat member 3 in the illustrated embodiment. A plurality of fuel injection holes 11 opening in the fuel diffusion chamber 36 at positions that are radially outwardly spaced from the outlet hole 7 are bored in the injector plate 16. The outlet hole 7 and each of the fuel injection holes 11 therefore communicate via the fuel diffusion chamber 36.

An inner peripheral face 7A of the outlet hole 7 is formed along a curved face on the inner peripheral side of a virtual torus T so as to be continuous with the base of the fuel collecting depression 35 and the roof of the fuel diffusion chamber 36.

Specifically, the virtual torus T is set so that a center To of a circular generatrix Ta thereof is positioned on a bisector L of an angle formed between the base of the funnel-shaped fuel collecting depression 35 and the roof of the fuel diffusion chamber 36, and the inner peripheral face 7A of the outlet hole 7 is formed by connecting a plurality of conical faces 7*a* and 7*b* that are in contact with the curved face on the inner peripheral side of the virtual torus T and have different conical angles, or by connecting the plurality of conical faces 7*a* and 7*b* having different conical angles and a cylindrical face 7*c* positioned therebetween.

The height t of the fuel diffusion chamber 36 is set at no more than ½ a radius r of the circular generatrix Ta of the virtual torus T, and desirably t=20 to 110 μm.

The operation of this embodiment is now explained.

Figure 2:
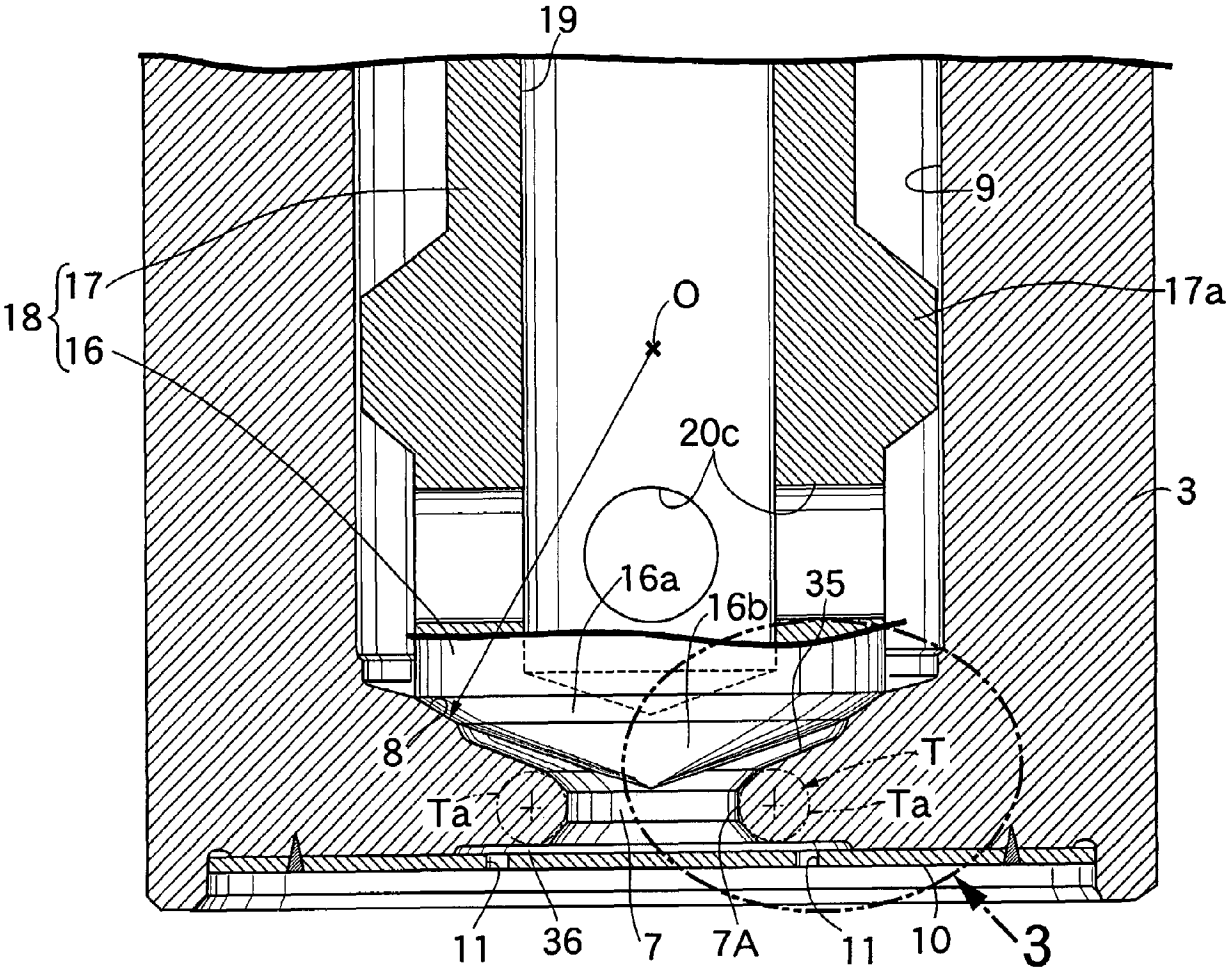
FIG. 2 is an enlarged view of part 2 in FIG. 1 (first embodiment).

As shown in FIG. 1 and FIG. 2, with the coil 30 in a de-energized state, the valve assembly V is pushed forward by virtue of the biasing force of the valve spring 22, thus seating the valve body 18 on the valve seat 8. Therefore, fuel that is pumped from a fuel pump (not illustrated) to the fuel inlet tube 26 passes through the interior of the pipe-shaped retainer 23, the lengthwise hole 19 and the first to third lateral holes 20*a* to 20*c* of the valve assembly V, held in readiness within the valve seat member 3, and supplied for lubrication of surroundings of the journal portions 17*a* of the valve body 18.

Figure 3:
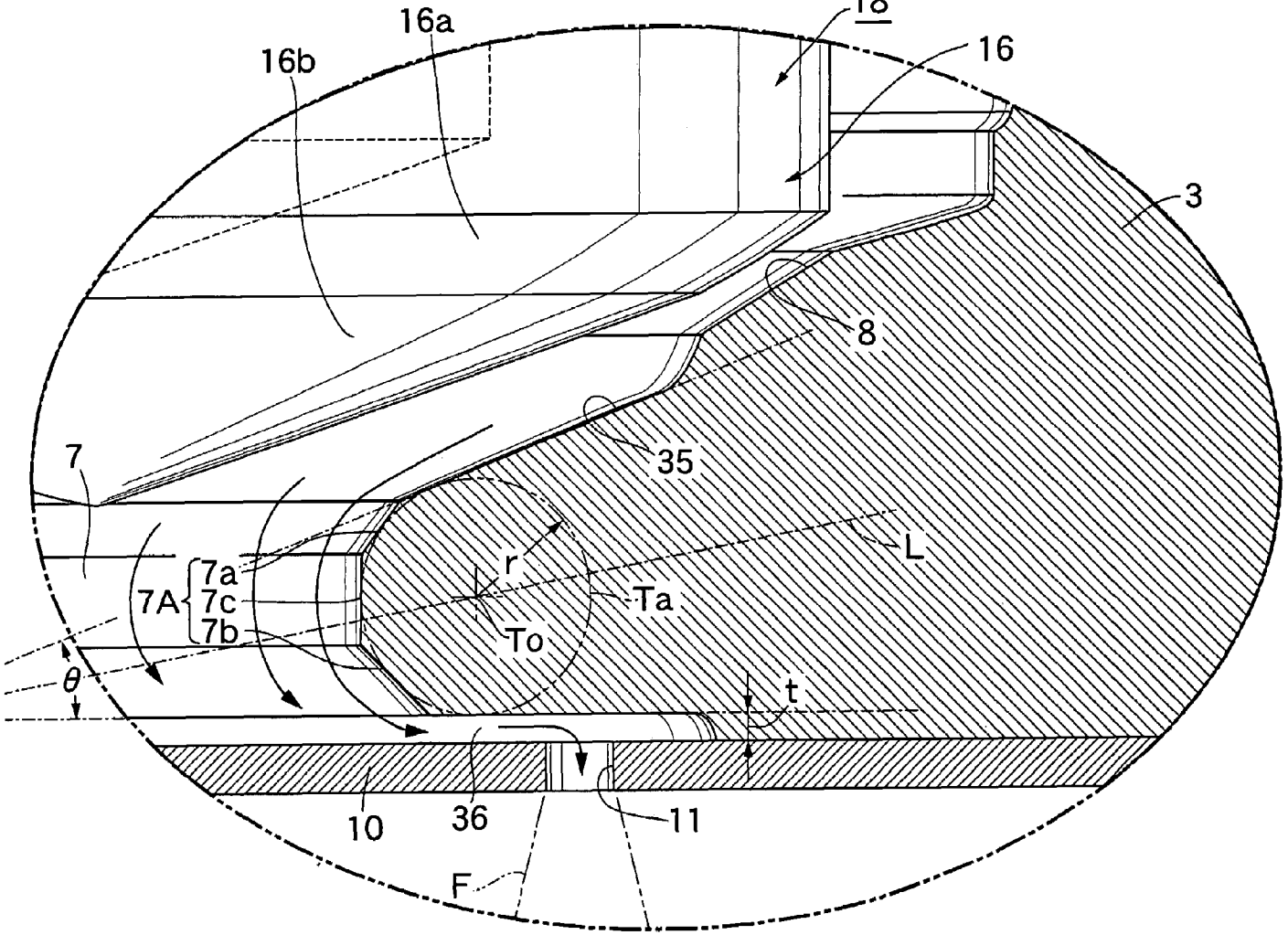
FIG. 3 is an enlarged view showing part 3 in FIG. 2 in a valve open state (first embodiment).

When the coil 30 is energized by passing electricity, magnetic flux thus produced runs in sequence through the fixed core 5, the coil housing 31, the cylindrical magnetic body 4, and the movable core 12, the movable core 12 of the valve assembly V is attracted to the fixed core 5 against the set load of the valve spring 22 by virtue of magnetic force, as shown in FIG. 3 the valve portion 16 of the valve body 18 separates from the valve seat 8 of the valve seat member 3, high pressure fuel within the valve seat member 3 therefore passes through the valve seat 8 and is then collected and guided to the outlet hole 7 by the fuel collecting depression 35, the flow thereof is reversed at the outlet hole 7, and the fuel moves on to the fuel diffusion chamber 36, diffuses radially outwardly, and is injected from the plurality of fuel injection holes 11 of the injector plate 10, thus forming a plurality of spray forms F.

As described above, since the inner peripheral face 7A of the outlet hole 7 is formed along the curved face on the inner peripheral side of the virtual torus T so as to be continuous with the base of the fuel collecting depression 35 and the roof of the fuel diffusion chamber 36, the reversal of the flow of fuel within the outlet hole 7 can be guided very smoothly by the inner peripheral face 7A, and eddies are prevented from being generated on the inside of the flow. As a result, it is possible to reduce pressure loss of the fuel, and promote the atomization of injected fuel and stabilize the spray form F without an accompanying reduction in the amount of fuel injected from each of the fuel injection holes 11, thereby contributing to a lowering of the engine fuel consumption and an improvement in output performance.

In particular, since the virtual torus T is set so that the center To of the circular generatrix Ta thereof is positioned on the bisector L of the angle formed between the base of the funnel-shaped fuel collecting depression 35 and the roof of the fuel diffusion chamber 36, it is possible to smoothly join the inner peripheral face of the outlet hole 7 to the base of the fuel collecting depression 35 and the roof of the fuel diffusion chamber 36, thus enabling the flow of fuel to be reversed within the outlet hole 7 more smoothly and thereby reliably preventing eddies from being generated on the inside of the flow.

Furthermore, when the inner peripheral face 7A of the outlet hole 7 is formed by connecting the plurality of conical faces 7*a* and 7*b*, which are in contact with the curved face on the inner peripheral side of the virtual torus T and have different conical angles, or by connecting the plurality of conical faces 7*a* and 7*b* having different conical angles and the cylindrical face 7*c* positioned therebetween, the inner peripheral face 7A of the outlet hole 7, which is along the curved face on the inner peripheral side of the virtual torus T, can be machined relatively easily by cutting, etc.

On the other hand, since the seating portion 16*a* of the valve portion 16 of the valve body 18 is formed in the spherical zone shape, the seating portion 16*a* being seated on the conical valve seat 8, it self-aligns relative to the valve seat 8, thus enabling a good valve closed state to be maintained at all times. Moreover, since the tip 16*b* of the valve portion 16 facing the fuel collecting depression 35 and outlet hole 7 is formed in a projecting conical shape so as to be continuous with the seating portion 16*a*, this tip 16*b* can reduce the dead volume of central portions of the fuel collecting depression 35 and the outlet hole 7, and a flow-straightening effect can be exhibited so as to promote collection and guiding of fuel from the fuel collecting depression 35 to the outlet hole 7, thus reducing pressure loss of the fuel.

Furthermore, setting the height t of the fuel diffusion chamber 36 at no more than ½ the radius r of the circular generatrix Ta of the virtual torus T increases the rate at which fuel diffuses in the fuel diffusion chamber 36, thus promoting the release of fuel at the open edge of each of the fuel injection holes 11, and thereby enabling injected fuel to be atomized effectively and, moreover, after fuel is injected, residual fuel can be reliably retained in the fuel diffusion chamber 36 by virtue of capillary action, thus preventing fuel from dripping from the fuel injection hole 11 and thereby contributing to a reduction in emissions. In particular, when the height t of the fuel diffusion chamber 36 is set at 20 to 110 μm, the dead volume of the fuel diffusion chamber 36 can be reduced, thus enhancing the above-mentioned effects, but if t is less than 20 μm, the flow path resistance increases, thus making it difficult to guarantee that a necessary amount of fuel is injected.

The present invention is not limited to the above-mentioned embodiment and can be modified in a variety of ways without departing from the spirit and scope of the present invention.

The invention claimed is:

1. A fuel injection valve comprising: a valve seat member having at one end portion thereof a valve seat and an outlet hole running through a central portion of the valve seat; a valve body housed in the valve seat member and opening and closing the valve seat; an injector plate joined to one end face of the valve seat member and having a plurality of fuel injection holes disposed so as to be radially outwardly spaced from the outlet hole; a funnel-shaped fuel collecting depression provided between the valve seat and the outlet hole, the funnel-shaped fuel collecting depression collecting fuel that has passed through the valve seat and guiding the fuel to the outlet hole; and a flat fuel diffusion chamber provided between opposing faces of the valve seat member and the injector plate, the fuel diffusion chamber radially outwardly diffusing fuel that has passed through the outlet hole and guiding the fuel to the plurality of fuel injection holes;

wherein an angle formed between a base of the fuel collecting depression and a roof of the fuel diffusion chamber is defined as an acute angle and a virtual torus is set to have a curve face on an inner peripheral side thereof placed in contact with the base of the fuel collecting depression and the roof of the fuel diffusion chamber; and wherein the outlet hole has an inner peripheral face thereof formed continuous with the base of the fuel collecting depression and the roof of the fuel diffusion chamber such that the inner peripheral face of the outlet hole is formed by connecting a plurality of conical faces having different conical angles or by connecting a plurality of conical faces having different conical angles and a cylindrical face positioned therebetween, the plurality of conical faces being in contact with the curved face on the inner peripheral side of the virtual torus.

2. The fuel injection valve according to claim 1, wherein the fuel diffusion chamber has a height thereof set at no more than ½ a radius of the circular generatrix of the virtual torus.

3. The fuel injection valve according to claim 1, wherein a seating portion of the valve body that is to be seated on the valve seat is formed in a spherical band shape, and a tip of the valve body that faces a section extending from the fuel collecting depression to the outlet hole is formed in a projecting cone shape.

* * * * *